US005115965A

United States Patent [19]

Girona Alepuz

[11] Patent Number: 5,115,965

[45] Date of Patent: May 26, 1992

[54] BOX FOR CONTAINING SPHERICAL BODIES

[75] Inventor: Eleuterio Girona Alepuz, Benifayo, Spain

[73] Assignee: Frutas Ballester, S.A., Benifayo, Spain

[21] Appl. No.: 597,822

[22] Filed: Oct. 15, 1990

[30] Foreign Application Priority Data

Jun. 27, 1990 [ES] Spain ..... 9001777

[51] Int. Cl.[5] ..... B65D 5/06

[52] U.S. Cl. ..... 229/109; 229/117.19; 229/117.25; 229/138; 229/DIG. 11; 206/315.9; 206/509

[58] Field of Search ..... 229/108, 109, 110, 138, 229/140, 915, 117.19, 117.25, DIG. 11; 206/509, 315.9, 418

[56] References Cited

U.S. PATENT DOCUMENTS

| | | | |
|---|---|---|---|
| 2,147,503 | 2/1939 | Seifer | 229/117.19 |
| 3,337,033 | 8/1967 | Cote | 206/418 |
| 3,907,194 | 9/1975 | Davenport et al. | 229/109 |
| 3,977,594 | 8/1976 | Swan | 229/109 |
| 4,709,852 | 12/1987 | Stoll | 229/915 |
| 4,717,022 | 1/1988 | Combs | 229/109 |

FOREIGN PATENT DOCUMENTS

| | | | |
|---|---|---|---|
| 0181236 | 2/1965 | Austria | 206/418 |
| 2221897 | 2/1990 | United Kingdom | 229/138 |

*Primary Examiner*—Stephen Marcus
*Assistant Examiner*—Christopher McDonald
*Attorney, Agent, or Firm*—Darby & Darby

[57] ABSTRACT

The box is formed as of a rectangular cardboard sheet upon which there are parallel perforated fold lines (1) which determine, in the folding, the formation of a regular octagonal prism with the bases, partially open. Parallel to the edges of the sheet perforated fold lines (6) and (7) have been made forming two strips divided by the perforated fold lines (1), in which divisions there are diagonal perforated fold lines (8) that divide up the strips in triangular areas. Upon the folding of the sheet these triangular areas extend towards the inside of the prism and determine the narrowing and partial closing of the bases of the prism forming a diaphragm.

4 Claims, 4 Drawing Sheets

BOX FOR CONTAINING SPHERICAL BODIES

OBJECT OF THE INVENTION

The object of the invention refers to a box for containing spherical bodies, which has constructional features that permit a spherical body of certain dimensions to fit inside it, protecting its entire surface, and even permitting the stacking of boxes on top of each other, at the same time that the same is furnished with a handle for transporting the same.

BACKGROUND OF THE INVENTION

The packing of spherical bodies or the like generally starts from cubic boxes. In some cases in which the bodies to be transported have a certain weight, reinforced boxes are needed.

Prismatic shaped boxes with a hexagonal or octagonal base made out of wood are known in the prior art.

When they are made out of cardboard with the same shape, it is difficult to stack them. In any case it is difficult to transport the same by hand, since the box must be picked up with both hands and this is even more difficult when the bodies in question are heavy.

The ideal container for this type of body is that which permits stacking thereof and unitary transport.

DESCRIPTION OF THE INVENTION

To solve these problems, the invention offers a box, obtained from a rectangular-shaped cardboard sheet, which has some slots and diecuts made in the same, by means of which a prismatic body with an octagonal plan open at its two bases is formed. Parallel to the edges of said bases there are both perforated fold lines that delimit the strip cut by the folding lines of the walls. In each one of the areas delimited by the perforated fold lines parallel to the edges, there is a diagonal perforated line, in alternating position, forming a regular broken line along the entire extension of the strip, which determine triangular areas, which by means of alternating folding towards the inside, form a diaphragm that narrows each one of the mouths of the prism, constituting in one case, a partial closing determining the support base for the spherical body, and in the other case, the lid.

In the position coincident with the four dihedral angles of the planes of the walls in an alternating arrangement, starting in the longitudinal perforated fold folding lines of the diaphragms, on one case some trapezium-shaped or similar diecuts appear, determining housings for some identically shaped tongues obtained, in the other case, from longitudinal folding lines of the other diaphragm. This arrangement of housings and tongues permit boxes to be stacked on one another.

The handle is a cardboard strip formed by diecut that has in the ends thereof some foldable spear tips for the introduction thereof in two diametrically opposite spaces, taking advantage of the grooves determined by the formation of the stacking tongues, whose spear tips open up after being put in place, remaining prevented from removal, upon remaining parallel to the walls of the prism and retained by the diaphragm itself.

The box is supplied folded flat and with the handle loose, which is assembled upon remaining formed the box with the diaphragm of the area of the tongues, loading the product at the opposite base, which is closed with the diaphragm of the area of the housings, where the tongues are situated in the stacking position.

As is understood from the description made, the box turns out to be very simple, easy to construct and assemble and extremely resistant.

Upon the surfaces of the prism some windows which affect the alternating surfaces and which permit one to see the contents have been made by diecuts.

BRIEF DESCRIPTION OF THE DRAWINGS

The drawings that are attached hereto show the box in different positions and details.

DESCRIPTION OF A PREFERRED EMBODIMENT

Figure 1:
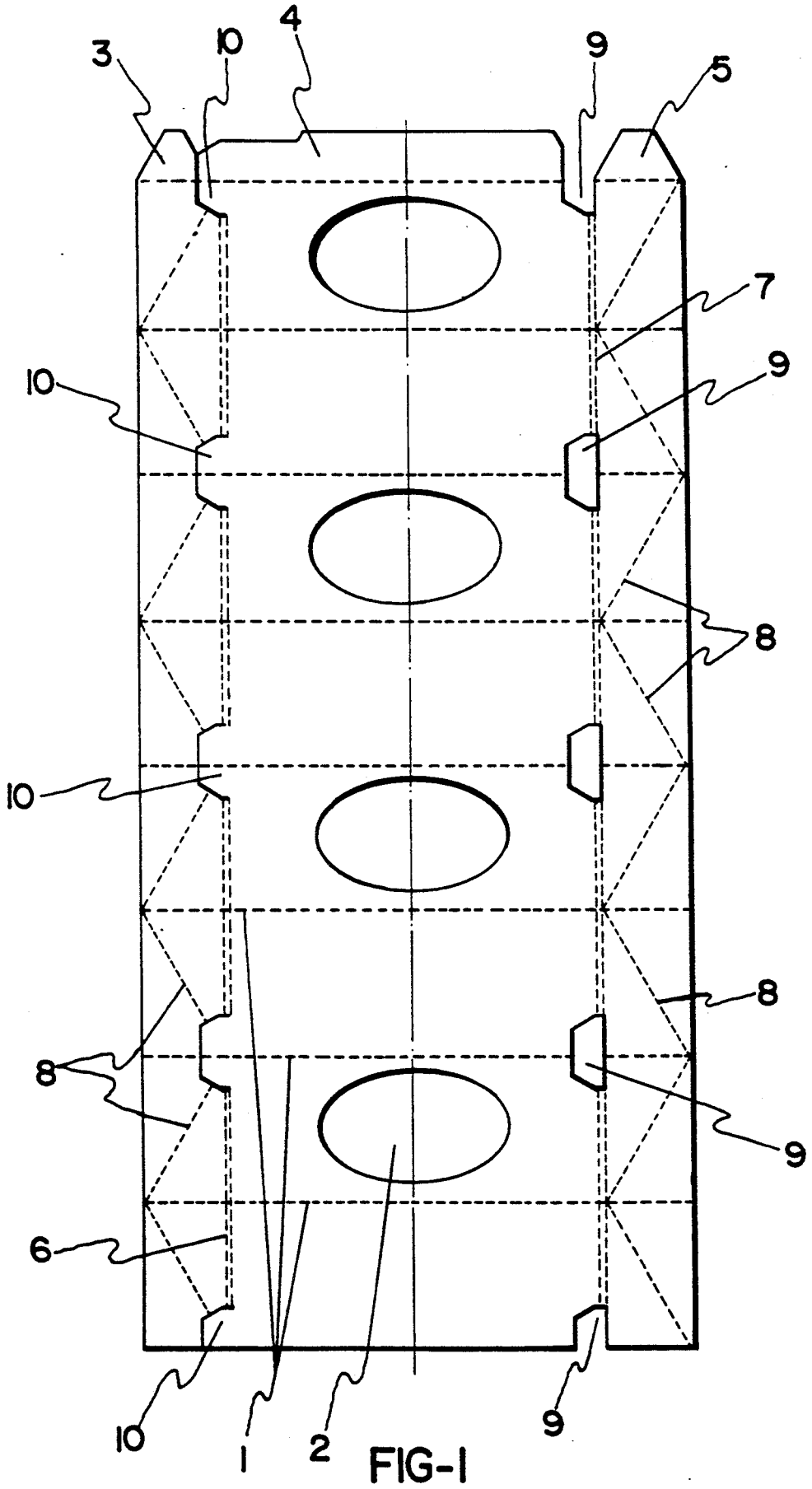
FIG 1. It is a development of the cardboard sheet from which the octagonal prismatic box is obtained.
Figure 2:
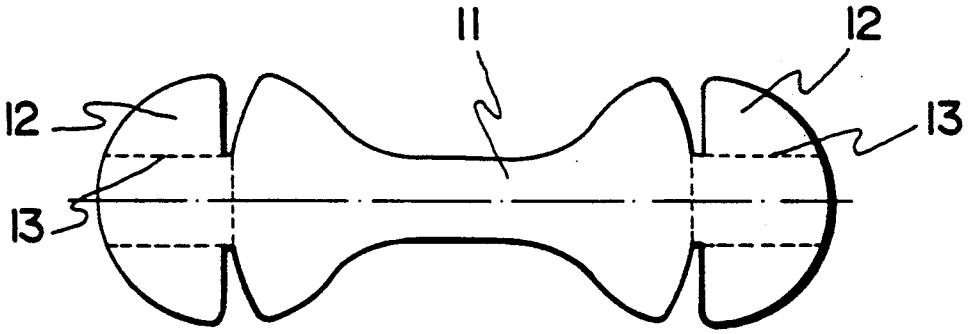
FIG. 2. It is a development of the handle, also of cardboard and diecut.

In accordance with the drawings referred to, one can see that the box, obtained from a rectangular shaped cardboard sheet (FIG. 1), provided with perforated fold lines (1), which determine the formation of eight surfaces of a regular octagonal prism, in which diecuts (2) have been alternately provided forming oval windows. In one of its ends the sheet has some flaps (3), (4) and (5) by which it is glued to the other end of the sheet for the formation of the prism that remains initially with the open bases.

All along the sheet and parallel to the edges of the perforated fold lines, slots (6) and (7) have been formed determine the formation of two identical strips defined by the perforated fold lines (1). The rectangular spaces of the strips are crossed diagonally by perforated fold lines (8) that divide them into triangular areas. The succession of these diagonal lines gives rise to the formation of a regular broken line in each strip.

Figure 3:
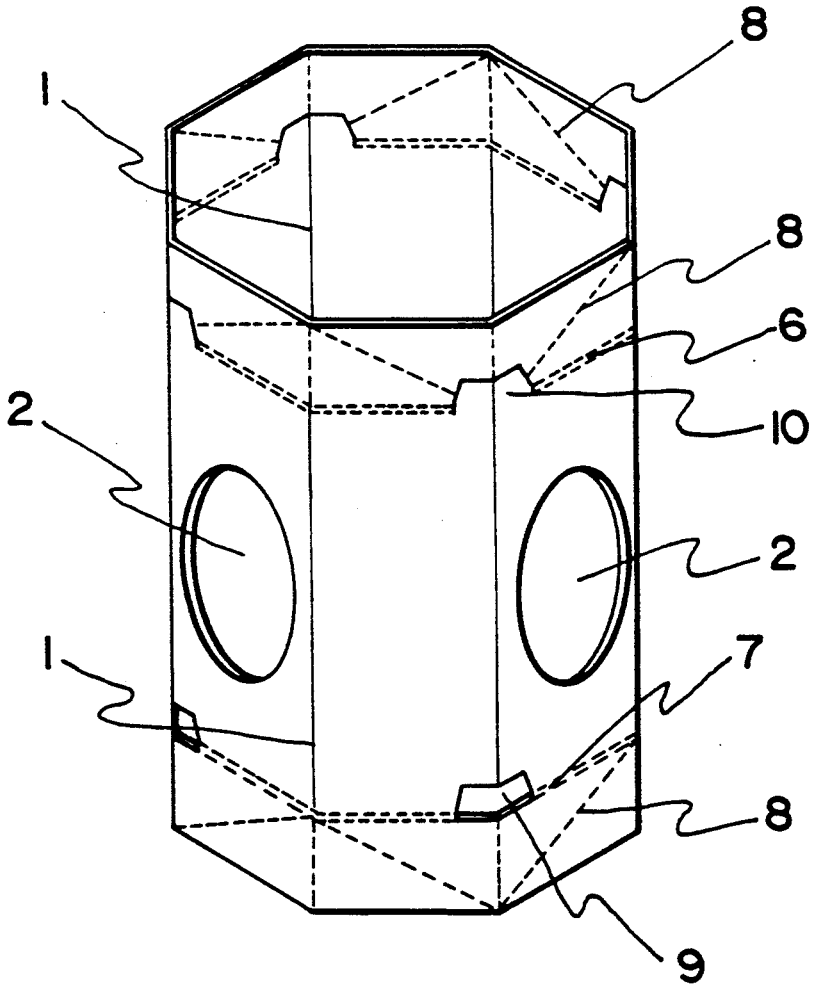
FIG. 3. It is a formation of the octagonal prism with the bases open, seen in perspective.
Figure 4:
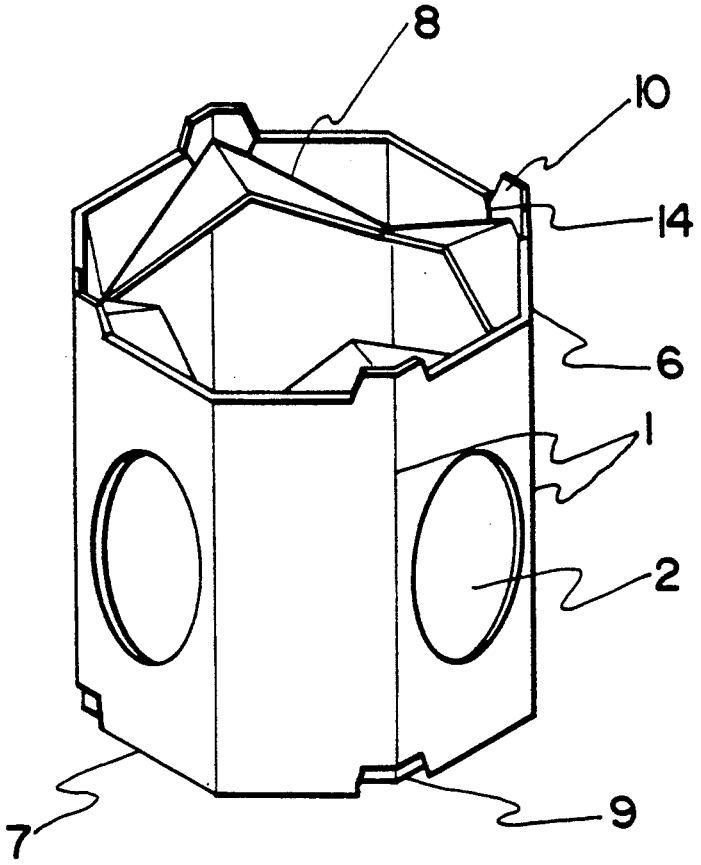
FIG. 4. It is a perspective view of the box with the bases partially closed with the corresponding diaphrams.

All of these lines together permit folding the triangular areas towards the inside (see FIG. 3), being folded in the shape of a diaphragm forming angular lips that narrow the bases and constitute in, one case, the base, and in the other, the lid.

In the position coincident with four of the dihedral angles formed by the planes of two contiguous and alternating walls starting at the longitudinal perforated fold lines (6) and (7) there are, in one case, some trapezium-shaped or similar diecuts (9) that determine housings for some identically shaped tongues (10), obtained in the other case, from the longitudinal perforated fold lines of the other diaphragm, all of which permits the stacking of the boxes.

Figure 5:
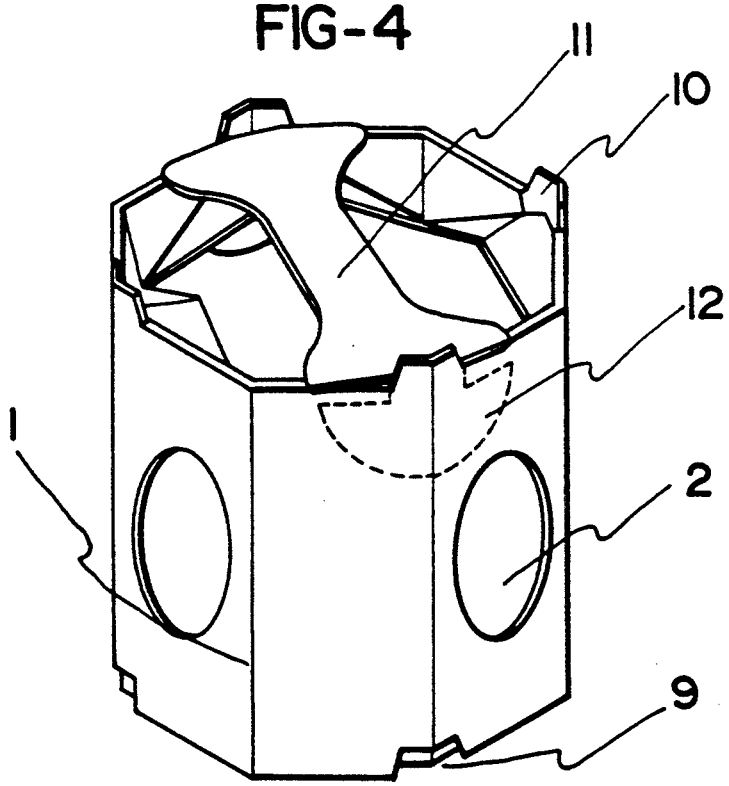
FIG. 5. It is the same perspective as above with the handle coupled.
Figure 6:
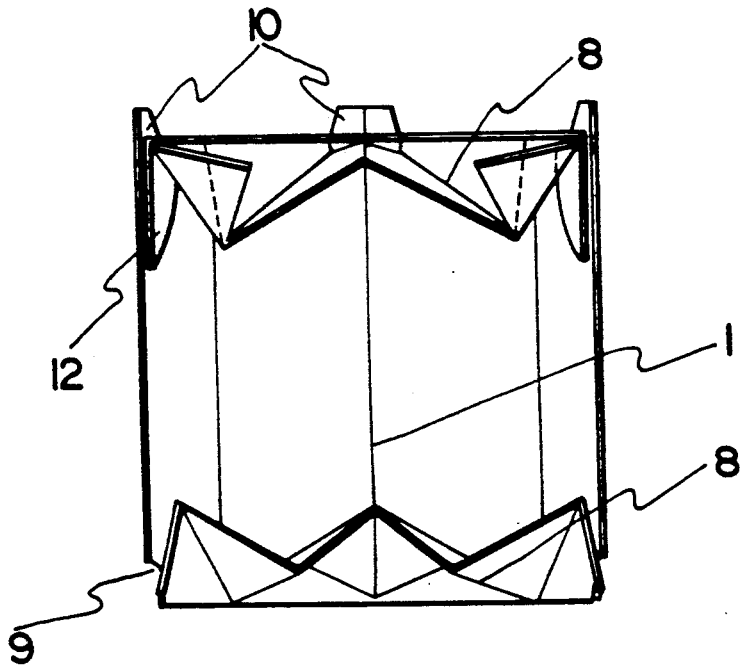
FIG. 6. It is a sectional detail of the coupling of the handle.
Figure 7:
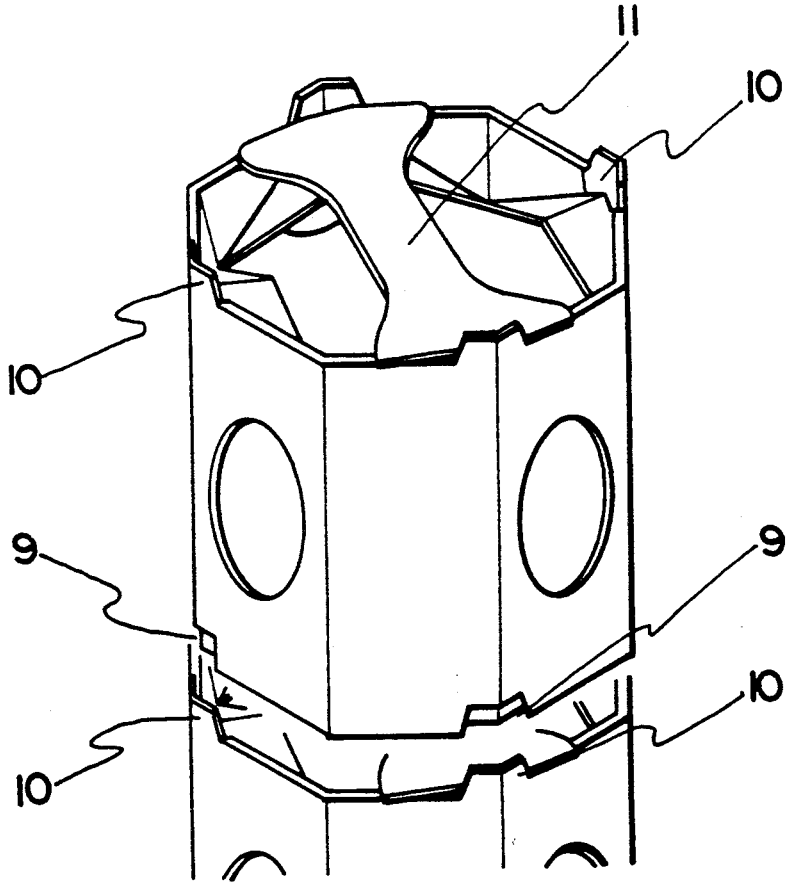
FIG. 7. It is a detail of the arrangement of two stacked boxes.

The handle is formed by a cardboard strip (11) formed by diecuts, which has the ends thereof cut off into spear tips (12.) These spear tips are folded according to slots (13) parallel to the symmetric axis and are introduced in the spaces (14) existing in the position of the tongues (10) (see FIGS. 4, 5, 6 and 7) and they open up after being introduced remaining backed to the walls of the box (see FIGS. 5 and 6.)

I claim:

1. A box for containing spherical bodies and made from a rectangular sheet of material having first and second long edges, a plurality of first longitudinal perforated lines extending between said edges so that upon folding of said sheet along said first lines a prismatic shaped box with an octagonal cross-sectional is formed, second and third parallel perforated lines formed in said sheet respectively positioned parallel and adjacent to first and second long edges, and a plurality of fourth diagonal perforated lines formed in said sheet extending from said second and third parallel perforated lines towards the respective first and second edges and between adjacent ones of said first perforated lines, said fourth diagonal lines extending in opposite diagonal directions between said second and third parallel line to the respective first and second edges and between said adjacent ones of said first perforated lines, the areas of said sheet defined by said fourth diagonal perforated lines being adapted to be folded inwardly of the box thereby forming alternating triangular folded areas which partially and identically enclose both ends of the box, leaving an opening in the box between said alternating triangular folded areas, whereby said triangular folded areas provide multiple support points for a spherical body within the box regardless of which end of the box provides the bottom of the box.

2. The box according to claim 1, further comprising a plurality of diecuts adjacent one of said parallel lines and a plurality of tongues adjacent the other one of said parallel lines, said diecuts having trapezium shapes and said tongues having shapes matching the shapes of said diecuts, said tongues being positioned to communicate with said diecuts of a like box when the box is stacked on top of said like box.

3. The box according to claim 2, further comprising a handle, said handle having a spear-shaped tip at either end, said tips being adaptable to be folded for the introduction thereof into spaces formed in the box below ones of said plurality of tongues, said tips being adapted to be unfolded after being introduced into said spaces, whereby said tips are positioned parallel to the wall of the box.

4. A box for containing spherical bodies and made from a rectangular sheet of material having first and second long edges, a plurality of first longitudinal perforated lines extending between said edges so that upon folding of said sheet along said first lines a prismatic shaped box with an octagonal cross-section is formed, second and third parallel perforated lines formed in said sheet respectively positioned parallel and adjacent to first and second long edges, a plurality of fourth diagonal perforated lines formed in said sheet extending from said second and third parallel perforated lines towards the respective first and second edges and between adjacent ones of said first perforated lines, the areas of said sheet defined by said fourth diagonal perforated lines being adapted to be folded inwardly of the box thereby forming alternating triangular folded areas which partially and identically enclose both ends of the box, whereby said triangular folded areas provide multiple support points for a spherical body within the box regardless of which end of the box provides the bottom of the box, a plurality of diecuts adjacent one of said parallel lines and a plurality of tongues adjacent the other one of said parallel lines, said diecuts having trapezium shapes and said tongues having shapes matching the shapes of said diecuts, said tongues being positioned to communicate with said diecuts of a like box when the box is stacked on top of said like box, and a handle, said handle having a spear-shaped tip at either end, said tips being adaptable to be folded for the introduction thereof into spaces formed in the box below ones of said plurality of tongues, said tips being adapted to be unfolded after being introduced into said spaces, whereby said tip is positioned parallel to the wall of the box.

* * * * *